US006491277B1

(12) United States Patent
Chappell et al.

(10) Patent No.: US 6,491,277 B1
(45) Date of Patent: Dec. 10, 2002

(54) MUSIC HOLDING DEVICE FOR A PIANO

(76) Inventors: Perry W. Chappell, P.O. Box 21424, Keizer, OR (US) 97307; Matthew E. Chappell, P.O. Box 21424, Keizer, OR (US) 97307

( * ) Notice: Subject to any disclaimer, the term of this patent is extended or adjusted under 35 U.S.C. 154(b) by 0 days.

(21) Appl. No.: 09/844,769

(22) Filed: Apr. 27, 2001

(51) Int. Cl.[7] ..... A47B 97/04
(52) U.S. Cl. ..... 248/459.1; 84/472
(58) Field of Search ..... 248/441.1, 459; 84/472

(56) References Cited

U.S. PATENT DOCUMENTS 556,064 A 3/1896 Pepper
875,220 A * 12/1907 Smith ..... 248/459
1,897,799 A 2/1933 Haight
3,086,658 A 4/1963 Palmer
3,119,194 A * 1/1964 Ray ..... 248/459
4,655,427 A 4/1987 Lamb
4,709,895 A * 12/1987 Mardak ..... 248/459
D321,293 S 11/1991 Kucsak
5,579,926 A 12/1996 Markarian
5,722,628 A * 3/1998 Menaged ..... 248/459
6,270,049 B1 * 8/2001 Ovvey ..... 248/441.1

* cited by examiner

*Primary Examiner*—Ramon O Ramirez

(57) ABSTRACT

A music holding device for a piano for protecting a piano and providing a support for music sheets and books. The music holding device for a piano includes a holder member including a folded-over panel member having a back portion and a front portion having a top edge which is integrally attached along a top edge of the back portion with the holder member being adapted to stand upon a surface of a piano with the front portion being adapted to support sheets and books of music.

7 Claims, 2 Drawing Sheets

MUSIC HOLDING DEVICE FOR A PIANO

BACKGROUND OF THE INVENTION

1. Field of the Invention

The present invention relates to a piano music stand and more particularly pertains to a new music holding device for a piano for protecting a piano and providing a support for music sheets and books.

2. Description of the Prior Art

The use of a piano music stand is known in the prior art. More specifically, a piano music stand heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 1,897,799; U.S. Pat. No. 556,064; U.S. Pat. No. 5,579,926; U.S. Pat. No. 3,086,658; U.S. Pat. No. Des. 321,293; and U.S. Pat. No. 4,655,427.

While these devices fulfill their respective, particular objectives and requirements, the aforementioned patents do not disclose a new music holding device for a piano. The inventive device includes a holder member including a folded-over panel member having a back portion and a front portion having a top edge which is integrally attached along a top edge of the back portion with the holder member being adapted to stand upon a surface of a piano with the front portion being adapted to support sheets and books of music.

In these respects, the music holding device for a piano according to the present invention substantially departs from the conventional concepts and designs of the prior art, and in so doing provides an apparatus primarily developed for the purpose of protecting a piano and providing a support for music sheets and books.

SUMMARY OF THE INVENTION

In view of the foregoing disadvantages inherent in the known types of piano music stand now present in the prior art, the present invention provides a new music holding device for a piano construction wherein the same can be utilized for protecting a piano and providing a support for music sheets and books.

The general purpose of the present invention, which will be described subsequently in greater detail, is to provide a new music holding device for a piano apparatus and method which has many of the advantages of the piano music stand mentioned heretofore and many novel features that result in a new music holding device for a piano which is not anticipated, rendered obvious, suggested, or even implied by any of the prior art piano music stand, either alone or in any combination thereof.

To attain this, the present invention generally comprises a holder member including a folded-over panel member having a back portion and a front portion having a top edge which is integrally attached along a top edge of the back portion with the holder member being adapted to stand upon a surface of a piano with the front portion being adapted to support sheets and books of music.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new music holding device for a piano apparatus and method which has many of the advantages of the piano music stand mentioned heretofore and many novel features that result in a new music holding device for a piano which is not anticipated, rendered obvious, suggested, or even implied by any of the prior art piano music stand, either alone or in any combination thereof.

It is another object of the present invention to provide a new music holding device for a piano which may be easily and efficiently manufactured and marketed.

It is a further object of the present invention to provide a new music holding device for a piano which is of a durable and reliable construction.

An even further object of the present invention is to provide a new music holding device for a piano which is susceptible of a low cost of manufacture with regard to both materials and labor, and which accordingly is then susceptible of low prices of sale to the consuming public, thereby making such music holding device for a piano economically available to the buying public.

Still yet another object of the present invention is to provide a new music holding device for a piano which provides in the apparatuses and methods of the prior art some of the advantages thereof, while simultaneously overcoming some of the disadvantages normally associated therewith.

Still another object of the present invention is to provide a new music holding device for a piano for protecting a piano and providing a support for music sheets and books.

Yet another object of the present invention is to provide a new music holding device for a piano which includes a holder member including a folded-over panel member having a back portion and a front portion having a top edge which is integrally attached along a top edge of the back portion with the holder member being adapted to stand upon a surface of a piano with the front portion being adapted to support sheets and books of music.

Still yet another object of the present invention is to provide a new music holding device for a piano that prevents music books from scratching the surface of the piano.

Even still another object of the present invention is to provide a new music holding device for a piano that is easy and convenient to simply stand upon the music desk of a piano.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
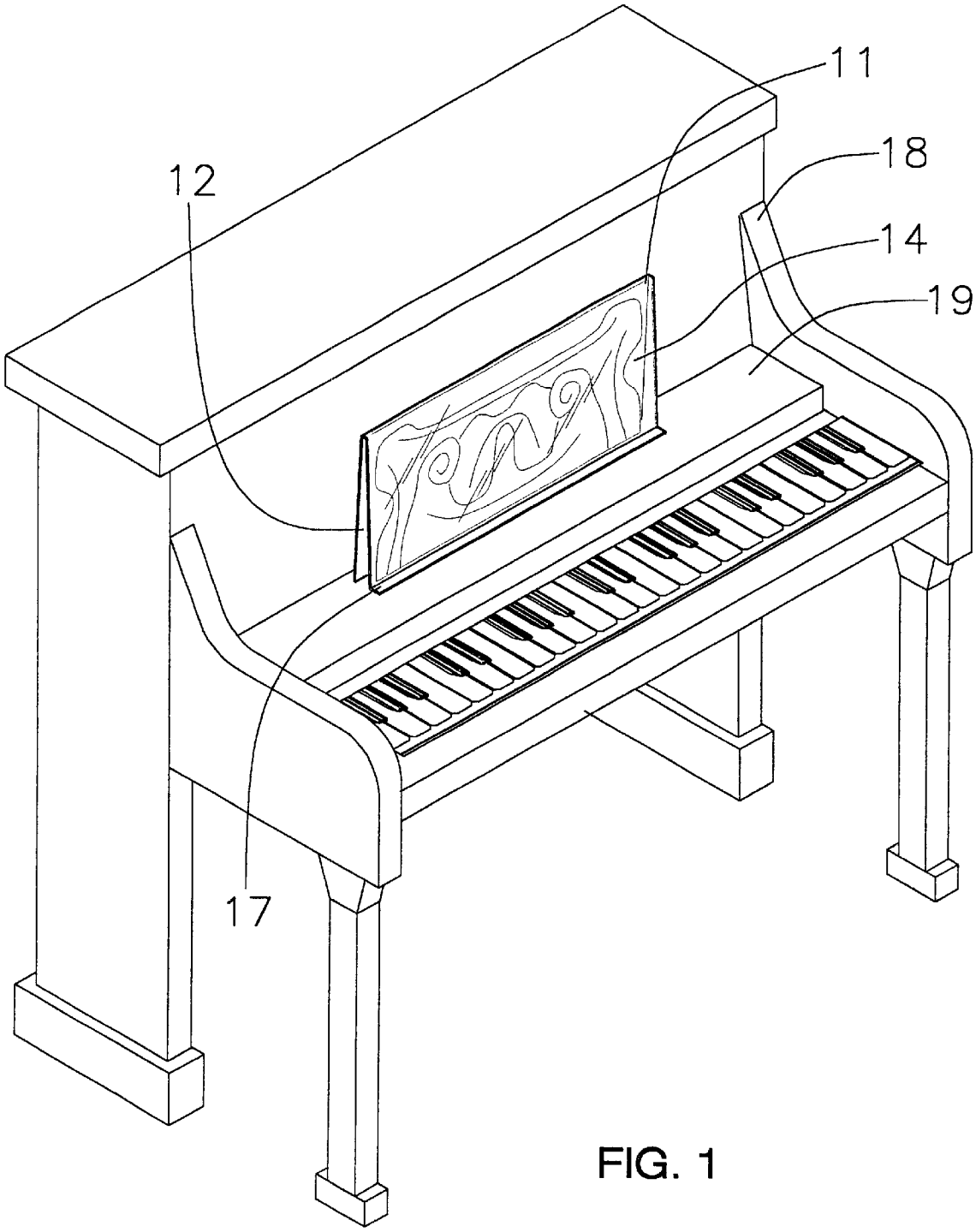
FIG. 1 is a perspective view of a new music holding device for a piano according to the present invention and shown in use.
Figure 2:
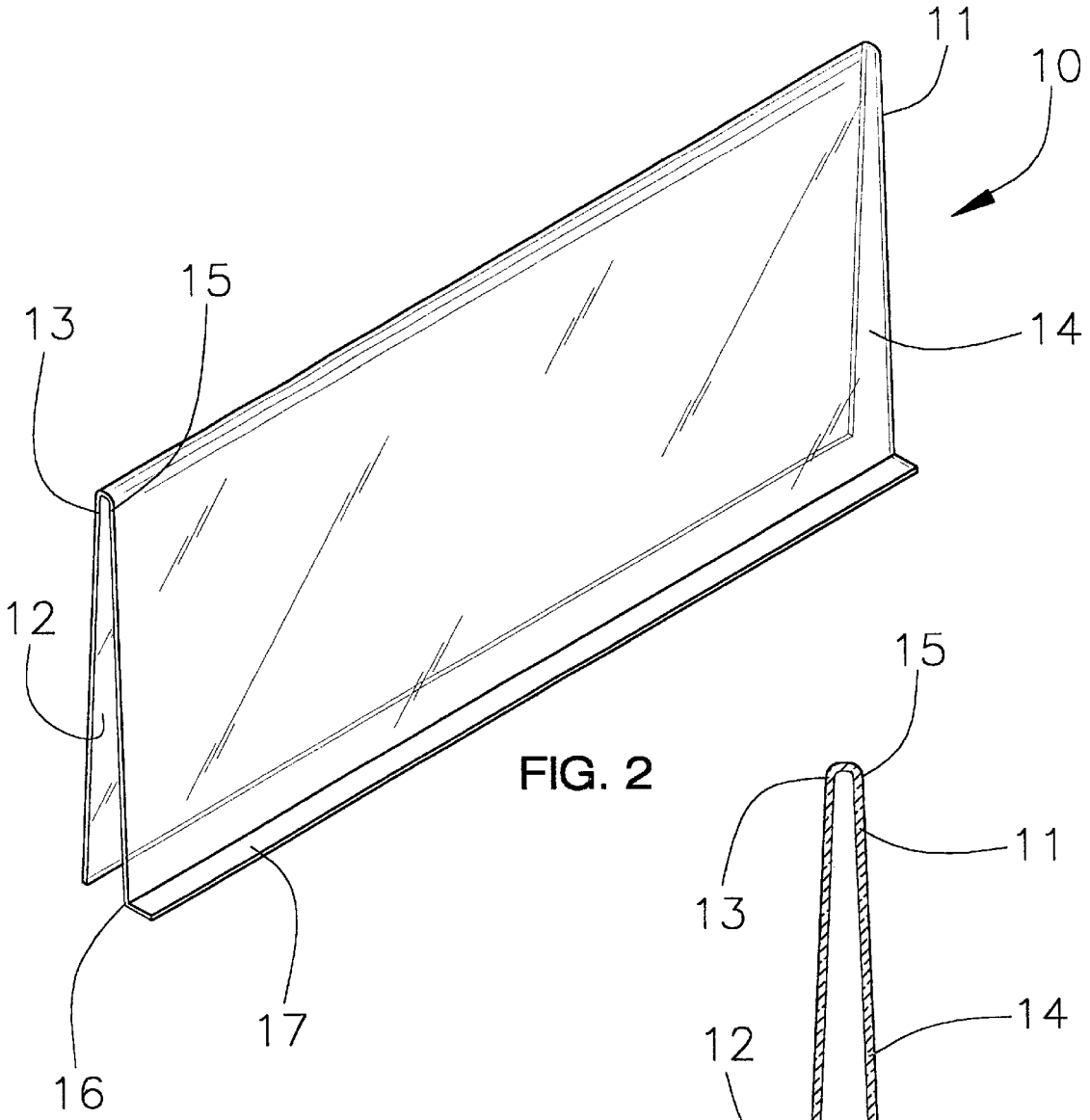
FIG. 2 is a perspective view of the present invention.
Figure 3:
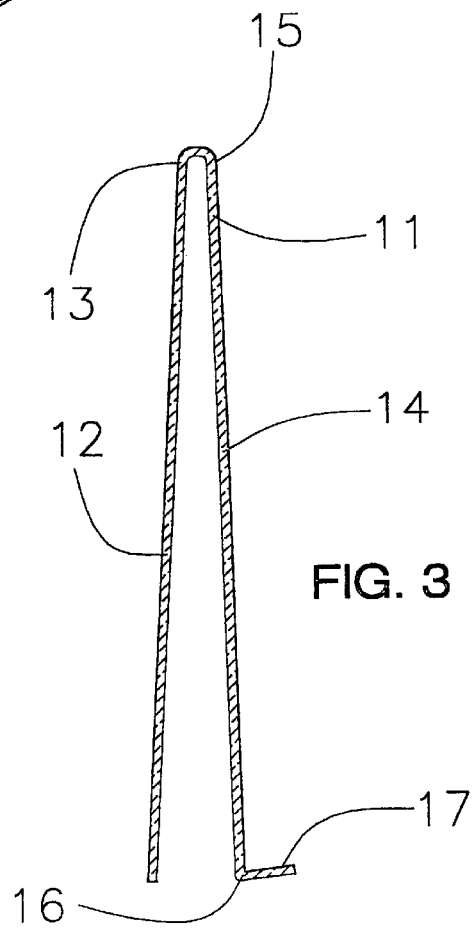
FIG. 3 is a side elevational view of the present invention.

With reference now to the drawings, and in particular to FIGS. 1 through 3 thereof, a new music holding device for a piano embodying the principles and concepts of the present invention and generally designated by the reference numeral 10 will be described.

As best illustrated in FIGS. 1 through 3, the music holding device for a piano 10 generally comprises a holder member including a folded-over panel member 11 having a back portion 12 and a front portion 14 having a top edge 15 which is integrally attached along a top edge 13 of the back portion 12. The holder member is adapted to stand upon a surface of a music desk 19 on a piano 18 with the front portion 14 being adapted to support sheets and books of music. The holder member further includes a base portion 17 being integrally attached along a bottom edge 16 of the front portion 15 and being angled outwardly relative to the front portion 15 and being adapted to rest upon a level surface to allow the holder member to stand upright upon the surface. The base portion 17 is a narrow strip portion extending outwardly along a length of the front portion 14. The front and back portions 12,14 of the panel member 11 form essentially an inverted V-shape with the front and back portions 12,14 being angled away relative to one another. The top edges 13,15 of the front and back portions 12,14 are rounded with each of the front and back portions 12,14 having a length of approximately 25 to 30 inches and a height of approximately 10 to 12 inches.

In use, the user places the holder member upon a decorative music desk and places sheets and books of music upon the base portion 17 and leans the sheets and books of music against the front portion 14 of the panel member 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A music holding device for a piano comprising:

a holder member including a folded-over panel member having a back portion and a front portion having a top edge which is integrally attached along a top edge of said back portion, said holder member being adapted to stand upright upon a surface of a piano with said front portion being adapted to support sheets and books of music;

wherein said holder member further includes a base portion being integrally attached along a bottom edge of said front portion and being angled outwardly relative to said front portion; and wherein said base portion is a narrow strip portion extending outwardly along a length of said front portion in a fixed perpendicular relationship to said front portion of said holder member for supporting music sheets and permit the sheets to be turned while supported on said base portion.

2. A music holding device for a piano as described in claim 1, wherein said front and back portions of said panel member form essentially an inverted V-shape with said front and back portions being angled away relative to one another.

3. A music holding device for a piano as described in claim 1, wherein said top edges of said front and back portions are rounded.

4. A music holding device for a piano comprising:

a holder member including a folded-over panel member having a back portion and a front portion having a top edge which is integrally attached along a top edge of said back portion, said holder member being adapted to stand upright upon a surface of a piano with said front portion being adapted to support sheets and books of music;

wherein said holder member further includes a base portion being integrally attached along a bottom edge of said front portion and being angled outwardly relative to said front portion;

wherein said base portion is a narrow strip portion extending outwardly along a length of said front portion in a fixed perpendicular relationship to said front portion of said holder member for supporting music sheets and permit the sheets to be turned while supported on said base portion; and wherein said front and back portions of said panel member form an inverted V-shape with said front and back portions being angled away relative to one another, said top edges of said front and back portions being rounded, each of said front and back portions having a length of approximately 25 to 30 inches and a height of approximately 10 to 12 inches.

5. A system for protecting a music table of a piano, and supporting music sheets, said system comprising:

a piano having a music table extending upwardly from a substantially horizontal surface on said piano;

a music holding device for positioning over the music table of said piano and holding music sheets; said device comprising:

a holder member including a folded-over panel member having a back portion and a front portion, said front and back portions being integrally attached along top edges of said front and back portions and defining a gap between lower edges of said front and back portions, said holder member being removably positioned on the substantially horizontal surface with said music tablet being removably received in said gap between said front and pack portions of said holder member;

wherein said holder member further includes a base portion being integrally attached along a bottom edge of said front portion and being angled outwardly relative to said front portion; and wherein said base portion is a narrow strip portion extending outwardly along a length of said front portion in a fixed perpendicular relationship to said front portion of said holder member for supporting music sheets and permit the sheets to be turned while supported on said base portion.

6. A music holding device for a piano as described in claim 5, wherein said front and back portions of said panel member form an inverted V-shape with said front and back portions being angled away relative to one another.

7. A music holding device for a piano as described in claim 5, wherein said top edges of said front and back portions are rounded.

* * * * *